United States Patent [19]

Schwarz

[11] Patent Number: 4,650,396

[45] Date of Patent: Mar. 17, 1987

[54] EXTERNALLY ADJUSTABLE AXIAL LOCATION FOR A VANE CARRIER IN A TURBINE

[75] Inventor: Hans Schwarz, Umiken, Switzerland

[73] Assignee: BBC Brown, Boveri & Company, Limited, Baden, Switzerland

[21] Appl. No.: 658,559

[22] Filed: Oct. 9, 1984

[30] Foreign Application Priority Data

Jan. 9, 1984 [CH] Switzerland ..... 80/84

[51] Int. Cl.[4] ..... F01D 25/24

[52] U.S. Cl. ..... 415/128; 415/219 R; 403/374

[58] Field of Search ..... 415/126, 128, 201, 219 R, 415/167, 134, 136, 138, 199.4, 199.5, 135, 137, 139, 127, 189, 191; 403/7, 374, 261; 285/39, 421

[56] References Cited

U.S. PATENT DOCUMENTS

| | | | |
|---|---|---|---|
| 764,433 | 7/1904 | Dodge | 415/126 |
| 1,060,945 | 5/1913 | Rice | 415/189 |
| 1,650,573 | 11/1927 | Searles | 403/261 |
| 2,777,665 | 1/1957 | Martinson | 415/134 |
| 2,801,075 | 7/1957 | Broffitt | 415/137 |
| 3,468,565 | 9/1969 | Roder | 403/261 |
| 3,628,878 | 12/1971 | Trassel et al. | 415/136 |
| 3,700,292 | 10/1972 | Owens | 403/13 |
| 3,824,034 | 7/1974 | Leicht | 415/219 R |
| 3,973,789 | 8/1976 | Kunz et al. | 285/39 |
| 4,078,812 | 3/1978 | Beckershoff | 415/139 |
| 4,208,165 | 6/1980 | Wikstrom | 415/199.5 |
| 4,373,827 | 2/1983 | Arndt | 415/14 |
| 4,592,699 | 6/1986 | Maierbacher | 415/126 |

FOREIGN PATENT DOCUMENTS

| | | | |
|---|---|---|---|
| 1153261 | 3/1958 | France | 415/219 R |
| 67806 | 4/1977 | Japan | 415/189 |
| 380753 | 8/1964 | Switzerland | 415/219 R |
| 708400 | 5/1954 | United Kingdom | 415/127 |
| 786689 | 11/1957 | United Kingdom | 415/139 |
| 808655 | 2/1959 | United Kingdom | 415/189 |
| 2026650 | 2/1980 | United Kingdom | 403/374 |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

A vane carrier (1) is axially located in an upper casing part (2) by means of a wedge (3). On the one hand, axial location, attainable by simple means, of the vane carrier (1) is desirable after the assembly of the upper casing parts (2). On the other hand, there is a requirement for easy release of the upper casing part (2) during the dismantling of the latter. During the assembly of the upper casing part (2), the wedge (3) is pulled tight against the vane carrier (1) by means of a screw (8). The vane carrier (1) is axially located in the upper casing part (2) by contact of the wedge contact surfaces (3', 3") with the surface (5) of the vane carrier (1) and with the surface (2") of the upper casing part (2). During dismantling of the upper casing part (2), the screw (8), and therefore the wedge (3), is loosened. When the upper casing part (2) is slightly raised, gaps form between the surfaces (2', 4) of the vane carrier (1) and the upper casing part (2), between the surfaces (3', 5) of the wedge (3) and the vane carrier (1), between the part (2) and between the surfaces (35, 36) of the upper casing part (2) and the compressor part (28). This formation of gaps makes possible satisfactory dismantling and assembly of the upper casing part (2) without the danger of damage to the previously paired surfaces or the previously clearance fitted surfaces concerned.

6 Claims, 7 Drawing Figures

FIG.5
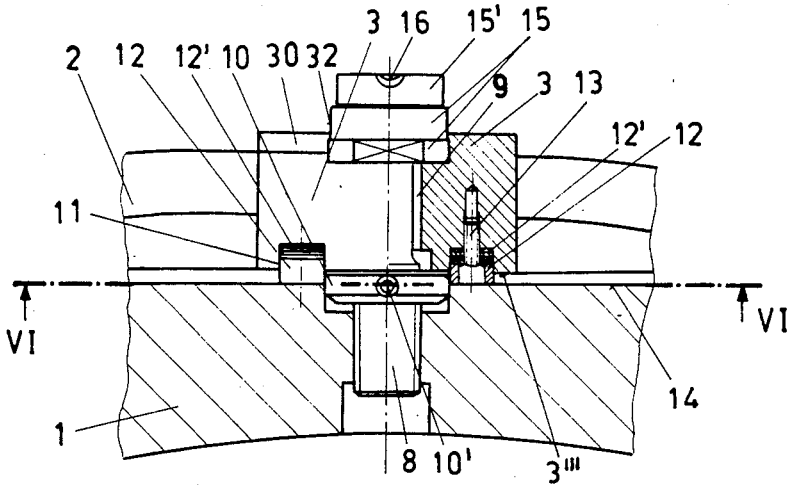
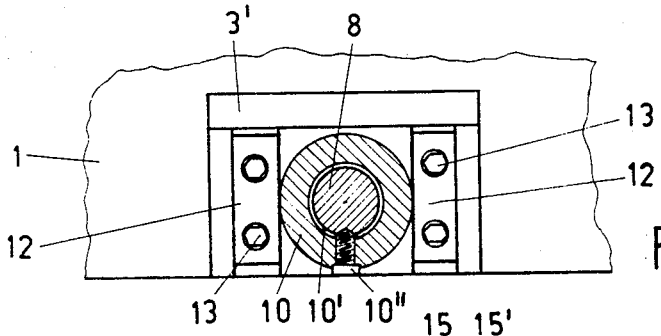
FIG.6
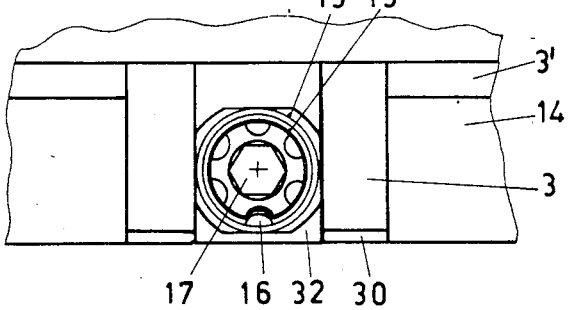
FIG.7

EXTERNALLY ADJUSTABLE AXIAL LOCATION FOR A VANE CARRIER IN A TURBINE

FIELD OF THE INVENTION

The invention concerns an externally adjustable axial location for a vane carrier in the upper part of a turbine casing.

BACKGROUND OF THE INVENTION

Turbo-machines normally have two-part rotationally symmetrical vane carriers which are mechanically connected at their largest diameters—and only there—to the lower casing part and the upper casing part. The connection between the vane carrier and the turbine casing can be produced either by a flange of the turbine casing engaging in a corresponding annular groove of the vane carrier or by a collar of the vane carrier engaging in a corresponding annular groove in the upper casing part and in the lower casing part. The turbine upper casing part extends in the axial direction from the largest diameter of the vane carrier to the compressor part of the turbine. A flange of the upper casing part makes contact with a corresponding flange of the compressor part and the two flanges are mechanically connected.

The upper casing part is supported on the lower casing part of the turbine in the horizontal plane through the turbine axis. The mechanical connection of the upper casing part to the vane carrier, on the one hand, and to the compressor part, on the other, is so dimensioned that it can satisfactorily deal with the high gas pressure within the turbine. This requires close dimensional tolerancing of the components quoted above. In addition, however, a clearance fit has to be provided between the upper casing part and the vane carrier and between the upper casing part and the compressor part, in order:

to facilitate assembly and dismantling of the turbine, to make sufficient allowance for the material expansions in the flange areas, arising due to thermal effects.

For the reasons given above, turbines normally have adjustment devices which are used, during dismantling, to provide variable clearance fits at the connection points between the turbine upper casing part and the vane carrier and, during assembly, to provide a mechanically fixed connection between the upper casing part and the vane carrier.

One known externally adjustable axial location is, for example, provided by means of an axially adjustable pin which can be adjusted by the use of an eccentric sleeve and which engages in a recess in the vane carrier.

In order to completely utilise the adjustment force, the known adjustment device must be located in the upper part of the turbine between the vane carrier fastening and the combustion chamber stub pipes. The space available, however, is very limited in this region. A feature of this adjustment device is, moreover, that it demands a relatively large amount of space and is associated with an additional accumulation of the volume of cast material in order adequately to dimension and locate all the necessary components. The region in which this adjustment device is located is subject to powerful thermal loads, and material deformations can occur due to widely varying wall thicknesses in the upper casing part.

OBJECTS OF THE INVENTION

The objective of the invention is to provide an externally adjustable axial location for a vane carrier in a upper casing part of a turbine, which axial location is easily integrated between the upper casing part and the vane carrier and by means of which it is possible to assemble or dismantle the upper casing part relative to the vane carrier easily and without damaging the paired surfaces and which, on the other hand, provides a clearance fit for thermal compensation between the upper casing part and the vane carrier.

ADVANTAGES OF THE INVENTION

One advantage of the invention consists in the fact that an axial clearance can be attained, on the one hand, between the paired surfaces of the upper casing part and the vane carrier and, on the other, between the paired surfaces between the upper casing part and the compressor part. By this means, assembling and dismantling of the upper casing part can be carried out easily and without damaging the paired surfaces.

A defined clearance fit between the end surface of the vane carrier collar and the wall (paired with this end surface) of the groove in the upper casing part can be attained by means of the screwed connection between the vane carrier and the upper casing part, via a wedge acting as a distance piece. By this means, the vane carrier is axially located in its specified position relative to the turbine casing. In addition, the installation of the wedge demands no change in the turbine casing apart from a small hole. Accumulations of material and their associated thermal stresses due to greatly varying wall thicknesses in the casing are avoided. The wedge can be located in a simple manner between the vane carrier and the upper casing part, and no space problems arise. In addition, the wedge has a large contact surface so that high pressure forces can be transmitted.

The wedge can, in a simple manner, be screwed to the vane carrier with axial clearance A large force component in the axial direction can be transmitted to the vane carrier when tightening the wedge, and a relatively small frictional adhesion has to be overcome when releasing the wedge.

When the upper part of the turbine casing is being assembled, a chamfer permits the turbine casing to be brought into its final position easily.

The wedge is adjustable in height using simple means, the clearance between the end surface of the vane carrier collar and the opposing wall of the groove in the upper casing part being adjustable in advance by means of the axial position of the wedge.

Release of the wedge when rotating the screw so that it moves upwards is facilitated by a drive washer located between the wedge and the vane carrier.

The screw which fastens the wedge to the vane carrier is secured against undesired loosening even during strong vibrations of the turbine.

The head of the screw fastens the wedge to the vane carrier. This arrangement makes possible simple tightening or release of the wedge from outside the upper casing part through an opening of small diameter.

BRIEF DESCRIPTION OF THE DRAWINGS

The invention is explained in more detail below using an embodiment shown in the drawings. In the drawings:

FIG. 5 shows a detail with a partial section at right angles to the sections shown in FIGS. 2 to 4, FIG. 6 shows a top view in partial section of the lower surface of the wedge in the direction of the arrows VI in FIG. 5, and FIG. 7 shows a top view of the head of the screw by means of which the wedge is fastened to the vane carrier, this view showing the position of the locking sleeve.

DETAILED DESCRIPTION OF THE PRESENTLY PREFERRED EMBODIMENT

Figure 1:
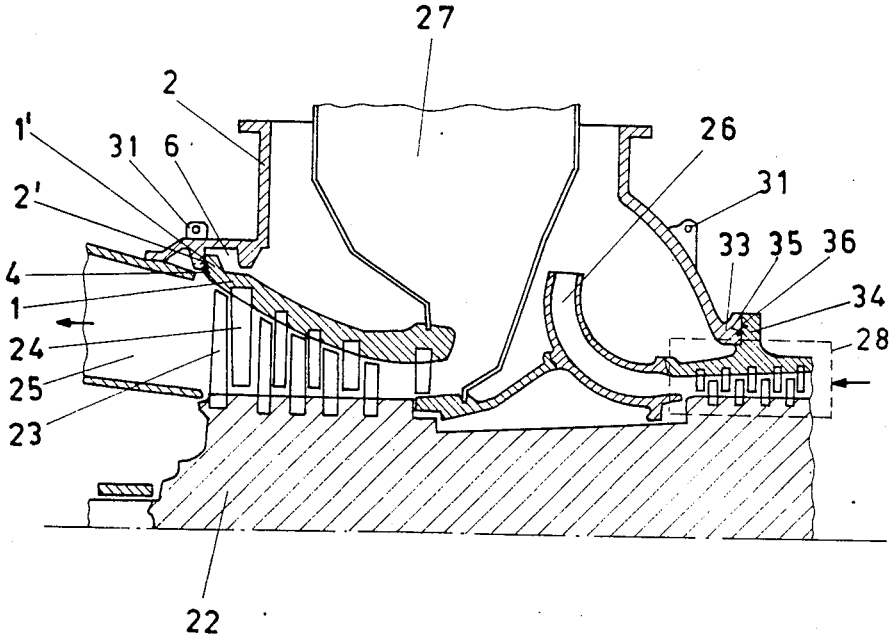
FIG. 1 shows an excerpt from a diagrammatic longitudinal section through a gas turbine.

In FIG. 1, 1 designates a vane carrier, 1' the vane carrier collar and 2 the upper part of a turbine casing. The vane carrier 1 engages in an annular groove 6 of the upper casing part 2. 22 designates a turbine rotor to which are fastened rotor blades 23, which alternate with stator blades 24 which are fastened to the vane carrier 1. 28 designates a compressor part. Air is driven by this compressor part 28, in the direction of the arrow, through an air duct 26 into the upper casing part 2. Heated combustion gases under pressure are supplied through a hot gas duct 27 to the rotor blades 23 and the startor blades 24. From there, they flow in the direction of the arrow into an exhaust gas duct 25.

The vane carrier collar 1' engages, as shown in FIG. 1, in the annular groove 6 of the upper casing part 2, and the end surface 4 of the vane carrier collar 2 faces towards the first groove wall 1'. On the opposite side of the upper casing part 2, a flange 34 of the compressor part 28 and a flange 33 of the upper casing part 2 form a contact pair by means of their appropriate surfaces—the flange surface 35 of the upper casing part 2 and the flange surface 36 of the compressor part 28. FIG. 1 also shows two lifting eyes 31 for lifting the upper casing part 2.

Figure 2:
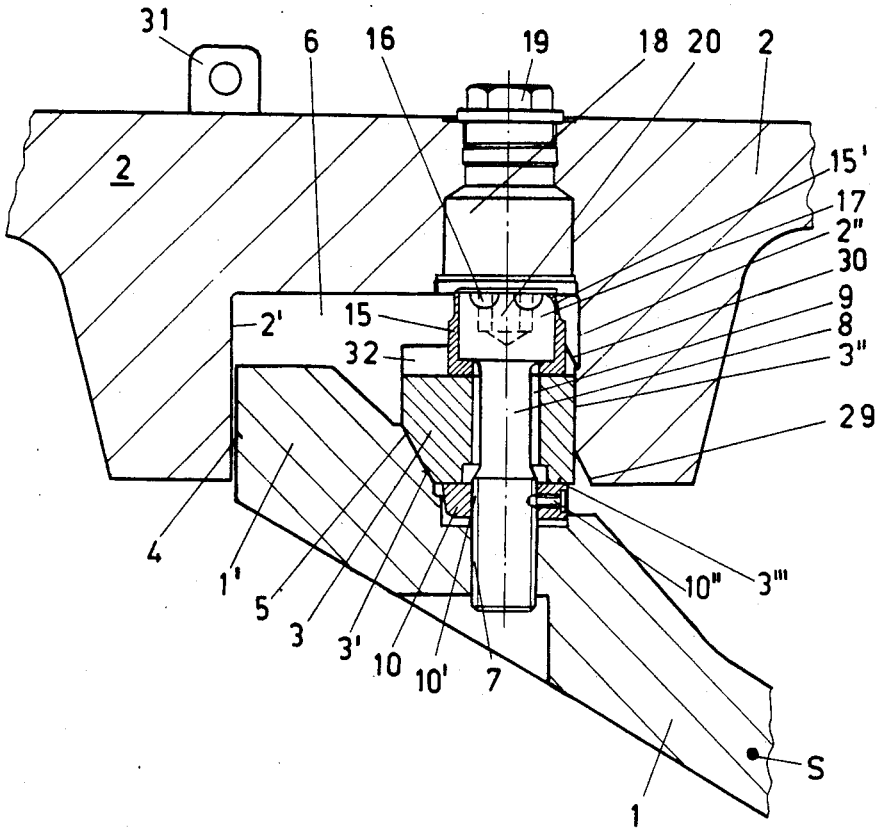
FIG. 2 shows an excerpt of a cross-section through the upper casing part and the vane carrier with the wedge pulled up, in accordance with FIG. 1.
Figure 3:
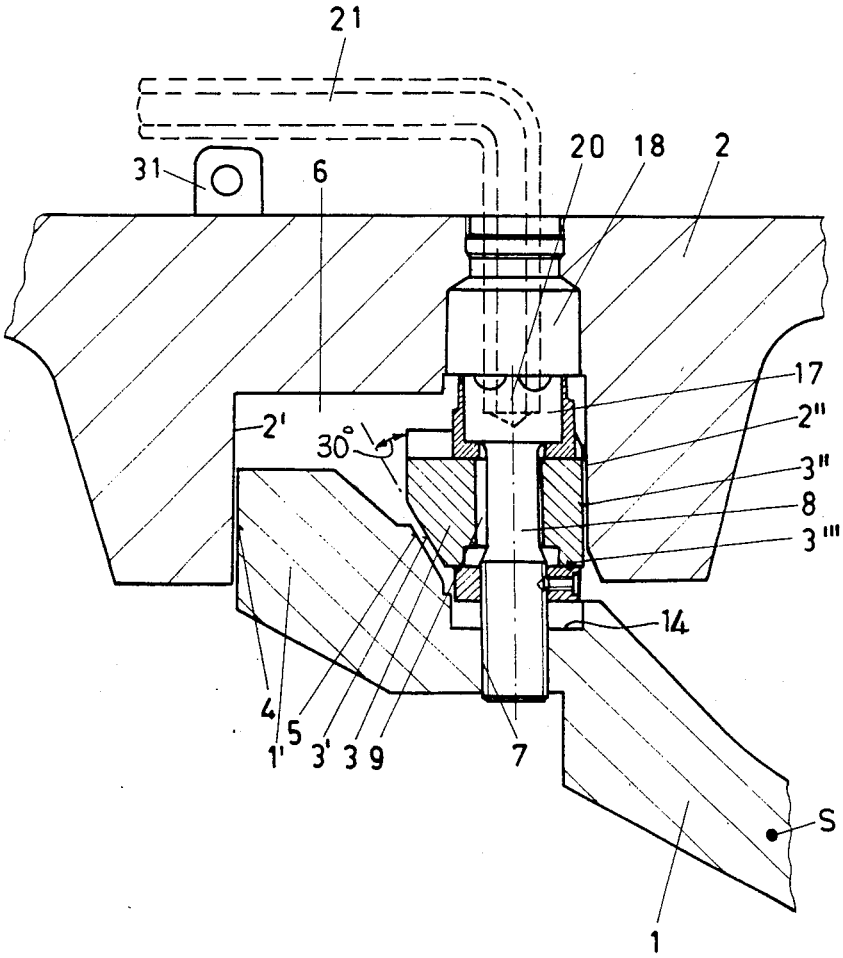
FIG. 3 shows an excerpt from a cross-section through the upper casing part and the vane carrier, with the wedge released, in accordance with FIG. 1.

FIGS. 2 and 3 show that the collar 1' of the vane carrier 1 engages in the annular groove 6 in the upper casing part 2. 3 designates a wedge which has a hole 9 for accepting a screw 8. The wedge 3 has an oblique surface 3' for making contact with a wedge contact surface 5 of the vane carrier 1. A vertical side surface 3'' of the wedge 3, which comes into contact with the second groove wall 2'' of the annular groove 6, is located on the opposite side of the wedge 3 from the oblique surface 3'. The wedge 3 also has a bottom surface 3''' and a chamfer 30 on the upper part. The chamfer 30 faces towards the second groove wall 2'' of the annular groove 6. The oblique surface 3' and the chamfer 30 of the wedge 3 are inclined at an angle of 30° relative to the screw 8. The angle of the oblique surface 3' should not be smaller than 20° and should not be larger than 40° in order to make possible an optimum pressure force and easy release of the wedge 3. The first groove wall 2' and the second groove wall 2'' are mutually parallel. In the upper part of the wedge 3, there is a groove 32 in which a locking sleeve 15 is retained so that it cannot rotate. The locking sleeve 15 enclosing the head 17 of the screw 8. The locking sleeve 15 has a bendable edge 15' which can be bent into a locking recesses 16 in the head 17 of the screw 8. The screw 8 is secured by this means against unintentional rotation in the operating condition of the machine. FIG. 2 also shows a hole 18 which is aligned with the axis of the screw 8. This hole can be closed off by means of a closure cap 19. The centre of gravity of the vane carrier 1 is designated by S.

The locking of the screw 8 is shown again and in more detail in FIG. 7.

FIGS. 2 and 3 show that there is an internal hexagonal recess 20 in the head 17 of the screw 8. As is shown in more detail in FIG. 3, an external hexagonal key 21 can be inserted in the internal hexagonal recess 20 through the hole 18 in the upper casing part 2.

The hole 9 in the wedge 3 has a larger diameter than the stem of the screw 8 i.e., the wedge 3 can be displaced in the axial direction by the order of magnitude of the clearance provided. The end region of the screw 8 is provided with a thread by means of which the screw 8 can be screwed into a threaded hole 7 in the vane carrier 1. As may be seen from FIG. 2, a drive washer 10 with a central threaded hole 10' is located below the wedge 3. The drive washer 10 is fastened to the screw 8 by means of a set screw 10''.

The end surface 4 of the vane carrier 1 faces towards the first groove wall 2' of the annular groove 6 in upper casing part 2. The upper casing part 2 has, at the outer end of the second groove wall 2'' of the annular groove 6, a chamfer 29 which, like the chamfer 30 on the wedge 3, has an angle of between 20° and 40°, in particular 30°, relative to the screw 8. The chamfers 29 and 30 ensure that, during lowering of the upper casing part 2, the outer edge of the annular groove 6 does not come into contact with the upper edge of the wedge 3 because the chamfers 29 and 30 cause the loosened wedge to be displaced axially in the direction of the end surface 4 of the vane carrier collar 1'.

FIG. 2 shows the wedge 3 in the tightly screwed up condition after assembly and before the turbine is put into operation.

In order to release the wedge 3, the screw 8 is rotated by means of the external hexagonal key 21 so that it moves slightly upwards. The drive washer 10 connected to the screw 8 then lifts the wedge 3, as may be seen in FIG. 3. This causes a gap to appear between the oblique surface 3' of the wedge 3 and the wedge contact surface 5 of the vane carrier collar 1'. If one then lifts the upper casing part 2 by crane hooks inserted in the lifting eyes 31, there then appears (as shown in FIGS. 1 and 3) the possibility of a slight axial displacement of the upper casing part 2 towards the left, relative to the vane carrier 1 and the compressor part 28. The axial displacement of the upper casing part 2 causes the formation of gaps between the following previously paired surfaces:

between the end surface 4 of the vane carrier collar 1' and the first groove wall 2' of the annular groove 6 in the upper casing part 2, as shown in FIG. 3, between the wedge contact surface 5 of the vane carrier 1 and the oblique surface 3' of the wedge 3, as shown in FIG. 3, between the side surface 3'' of the wedge 3 and the second groove wall 2'' of the annular groove 6 in the upper casing part 2, as shown in FIG. 3, between the flange surface 36 of the flange 34 of the compressor part 28 and the flange surface 35 of the flange 33 of the upper casing part 2, as shown in FIG. 1. (This gap is not, however, shown in FIG. 1.)

FIG. 3 shows clearly that the wedge 3 is not only raised but is also slightly displaced towards the left. This is indicated by the fact that the gap between the stem of the screw 8 and the right-hand part of the wedge 3 is smaller than the gap between the stem of the screw 8 and the left-hand part of the wedge 3. This displacement of the wedge 3 towards the left can be easily recognised by comparing FIGS. 2 and 3.

Figure 4:
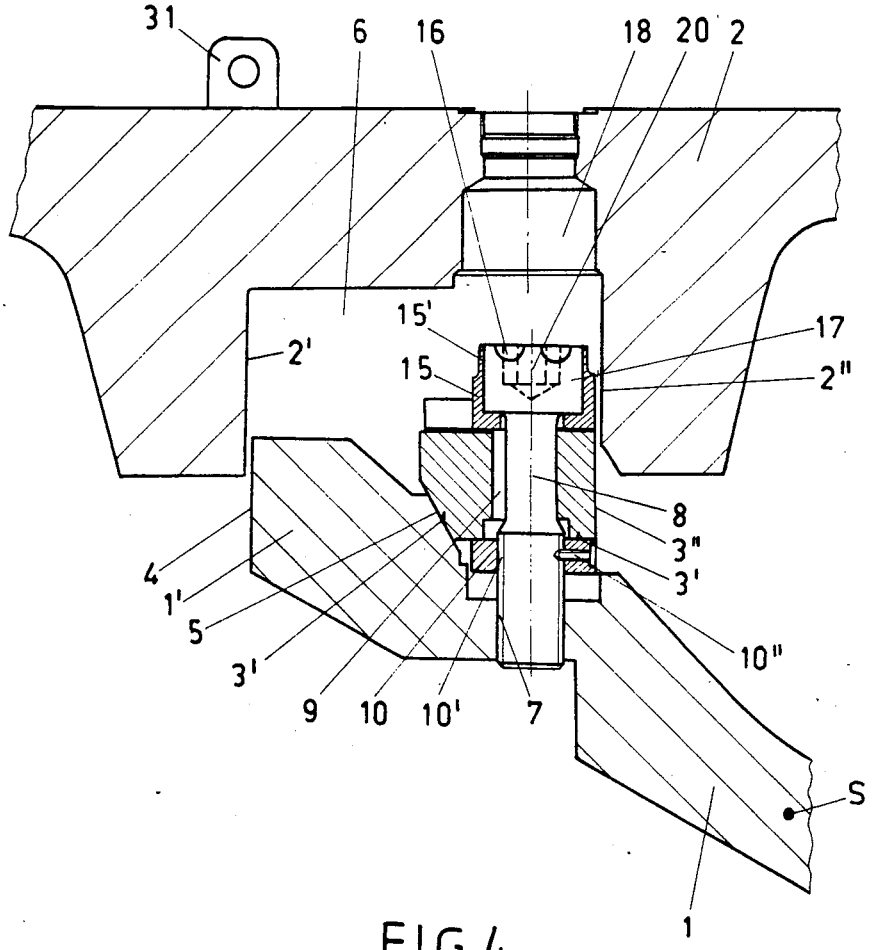
FIG. 4 shows an excerpt from a cross-section through the upper casing part and the vane carrier with the upper casing part raised.

As is shown in FIG. 4, the upper casing part 2 is again raised by crane hooks (not shown) inserted in the lifting eyes 31, the wedge 3 being of course loosened, as comprehensively described with reference to FIG. 3. As is shown in FIG. 4, the oblique surface 3' of the wedge 3 has again been pressed onto the wedge contact surface 5 of the vane carrier collar 1' by slight axial displacement of the upper casing part 2 during the raising procedure. The displacement of the wedge 3 towards the left, shown in FIG. 4, is clearly indicated by the fact that the right-hand gap between the stem of the screw 8 and the right-hand part of the wedge 3 is completely closed i.e., the stem of the screw 8 comes into contact with the right-hand part of the wedge 3. On the other hand, the left-hand gap between the screw 8 and the left-hand part of the wedge 3 is increased. A comparison of FIGS. 2 to 4 clearly shows the change in the gaps to the left and right of the stem of the screw 8 as a consequence of the individual procedures described above.

FIG. 5 shows a detailed view of the wedge 3 at right angles to the sections shown in FIGS. 2 to 4. Two recesses 11, in which are located distance pieces 12 and shim plates 12', are provided on a bottom surface 3''' of the wedge 3 and are facing towards the vane carrier 1 at the edges of the drive washer 10. The wedge 3 is therefore supported on the floor surface 14 of the vane carrier 1 via the distance pieces 12. A variable distance between the wedge 3 and the vane carrier 1 can be attained by means of the shim plates 12'. This variably adjustable distance is dealt with again in even more detail below during the description of the method of operation of the axial location in accordance with the invention.

In FIG. 5, the wedge 3 is shown partially sectioned and partially in top view. It can be seen that the distance piece 12 and the shim plates 12' shown in section on the right-hand side of FIG. 5 are fastened to the wedge 3 by means of a screw 13. This also applies, of course, to both the distance pieces 12 and the shim plates 12' shown on the left-hand side of FIG. 5. In the groove 32 in the upper part of the wedge 3 is located the locking sleeve 15 which, in the present case, is designed to be octagonal in the part engaging in the groove 32 and having two side surfaces solidly in contact with the walls of the groove 32. The bendable edge 15' on the upper part of the locking sleeve 15 is, as already mentioned, bent into a locking recess 16 in the head 17 of the screw 8, and the screw 8 is firmly locked by this means under all operating conditions of the turbine. The head 17 of the screw 8 cannot be seen in FIG. 5. Because of the partially sectioned view of the wedge 3, the hole 9 for the screw 8 can be seen. Similarly, the chamfer 30 in the upper part of the wedge 3 can be easily seen, this chamfer being provided in order to avoid damage during the assembly of the upper casing part 2.

FIG. 6 shows a top view of the bottom surface of the wedge 3, the drive washer 10 and the screw 8 being shown sectioned. The location of the distance pieces 12, their fastening by means of the screws 13 and the oblique wedge support surface 3' can be easily seen in FIG. 6. The screw 8 is located in the central threaded hole 10' of the drive washer 10, and the drive washer 10 is fastened to the screw 8 by means of the set screw 10''.

FIG. 7 shows the way in which the locking sleeve 15 is supported in the groove 32 so as to be fixed against rotation. A displacement of the locking sleeve 15 together with the screw 8 relative to the wedge 3 along the groove 32 is, however, possible. The wedge 3 is guided at right angles to the turbine axis by the locking sleeve 15 located in the groove 32 and by the drive washer 10 located between the distance pieces 12.

The method of operation of the axial location in accordance with the invention is described in more detail below.

During the assembly of the turbine, the upper casing part 2 is lowered until it rests on a lower part which is not shown. The screw 8 is then tightened by means of the external hexagonal key 21. By this means, the upper casing part 2 together with the vane carrier 1 is axially located by means of the wedge 3 along with the distance pieces 12. In the condition where it is not axially located, the vane carrier 1, whose centre of gravity S lies to the right of the connection with the screw 8 (as shown in FIGS. 2 to 4), is inclined slightly to the right. When the screw 8 is tightened, the oblique surface 3' of the wedge 3 now presses on the wedge contact surface 5 of the vane carrier 1, and the end surface 4 of the vane carrier 1 is drawn into a vertical position. The first groove wall 2' of the annular groove 6 of the upper casing part 2 and the end surface 4 of the vane carrier 1 are now parallel but with a small clearance fit, whereas, before the axial location procedure, the first groove wall 2' and the end surface 4 enclosed a very small angle. The clearance fit between the first groove wall 2' and the end surface 4 is closed by the internal gas pressure when the turbine is put into operation. The clearance fit between the first groove wall 2' and the end surface 4 prevents too large a surface pressure occurring at the first groove wall 2' and the end surface 4 in the operating condition of the turbine; such a surface pressure could in some circumstances lead to material deformation on the upper casing part 2 and/or the vane carrier 1.

In the axially located condition after assembly and before the turbine is put into operation, the wedge 3 is in contact with the following surfaces of the vane carrier 1 and the upper casing part 2:

via the distance pieces 12 with the floor surface 14 of the vane carrier 1, by means of the already mentioned oblique surface 3' of the wedge 3 with the wedge contact surface 5 of the vane carrier 1, by means of the vertical side surface 3'' of the wedge 3 with the second groove wall 2'' of the annular groove 6 in the upper casing part 2.

As already mentioned, the gap between the end surface 4 of the vane carrier collar 1' and the first groove wall 2' of the annular groove 6 in the upper casing part 2 is closed in the operating condition of the turbine. A gap now forms between the vertical side surface 3'' of the wedge 3 and the second groove wall 2'' of the annular groove 6 in the upper casing part 2.

As described comprehesively with respect to FIG. 5, the wedge 3 can be adjusted in height by means of the shim plates 12'. This height adjustment affects the clearance fit between the first groove wall 2' and the end surface 4 in such a way that the clearance fit can be appropriately set to the particular turbine sizes and powers. After the screw 8 has been tightened, the bendable edges 15' of the locking sleeve 15 are now bent into the locking recesses 16 of the head 17 of the screw 8 so that the axial location of the vane carrier 1 and the upper casing part 2 is maintained under all operating conditions because the screw 8 is secured against loosening.

During dismantling of the upper casing part 2 of the turbine, the bendable edges 15' of the locking sleeve 15 are first pressed out of the locking recesses 16. The screw 8 is then screwed up a little by means of the external hexagonal key 21 so that a gap forms initially between the oblique surface 3' of the wedge 3 and the wedge contact surface 5 of the vane carrier 1. During the initial slight raising of the upper casing part 2, the latter can be slightly displaced axially towards the left with the wedge 3 loosened and because of the clearance between the hole 9 and the screw 8. The following small gaps then appear:

between the first groove wall 2' of the upper casing part 2 and the end surface 4 of the vane carrier 1, as shown in FIG. 3, between the obliqe surface 3' of the wedge and the wedge contact surface 5 of the vane carrier 1, as shown in FIG. 3, between the vertical side surface 3'' of the wedge 3 and the second groove wall 2'' of the upper casing part 2, as shown in FIG. 3, between the flange surface 35 of the upper casing part 2 and the flange surface 36 of the compressor part 28, as shown in FIG. 1, between the seating surface of the distance pieces 12 and the floor surface 14 of the vane carrier 1. (This gap is not, however, shown in FIG. 5.)

Due to the formation of the gaps mentioned above, the upper casing part 2 can now be raised easily and without danger of damage to the surfaces mentioned above. During assembly, the hole 18 in the upper casing part 2 is closed by means of the closure cap 19, the latter being used to open it again during dismantling.

The axial location in accordance with the invention is not, of course, limited to the embodiment described. Thus, for example, several wedges 3 can be used for the axial location of the vane carrier 1 and the upper casing part 2. The axial location in accordance with the invention is not limited to the upper region of the upper casing part 2 alone, but can also be located on the side region of the periphery of the turbine casing and the vane carrier collar 1'.

I claim:

1. A turbine in which the axial location of the vane carrier is externally adjustable, said turbine comprising:

(a) a rotor rotatable about an axis of rotation;

(b) a vane carrier surrounding said rotor, said vane carrier having a threaded hole therein and a radially outwardly projecting collar having:

(i) an end surface that is perpendicular to the axis of rotation and (ii)a wedge contact surface that is inclined toward said end surface;

(c) a plurality of rotor blades projecting radially outwardly from said rotor;

(d) a plurality of stator blades projecting radially inwardly from said vane carrier, said plurality of stator blades being interleaved among said plurality of rotor blades;

(e) a screw that is sized to be threadedly received in said threaded hole in said vane carrier;

(f) a casing surrounding said vane carrier, said casing having an internal annular groove, said internal annular groove being defined by a first groove wall and a second groove wall, said first and second groove walls being perpendicular to the axis of rotation of said rotor and parallel to each other, said casing and said internal annular groove being sized, shaped, and positioned so that said end surface of said radially outwardly projecting collar on said vane carrier faces said first groove wall and is slightly spaced therefrom during use of the turbine, said casing having a through hole that, during use of the turbine, is coaxial with said threaded hole in said vane carrier and that is sized and shaped to provide external access to said screw; and (g) a wedge disposed in said annular groove in said casing, said wedge having:

(i) an oblique surface which, during use of the turbine, makes surface contact with said wedge contact surface on said radially outwardly projecting collar on said vane carrier;

(ii) a vertical side surface which, during use of the turbine, makes surface contact with said second groove wall of said annular groove in said casing; and (iii) a radial throughole that is sized, shaped, and positioned to pass said screw with clearance that permits axial movement of said wedge relative to said screw during assembly and disassembly of the turbine.

2. A turbine as recited in claim 1 wherein:

(a) said wedge has a bottom surface facing a floor surface on said vane carrier;

(b) a recess is provided in said bottom surface of said wedge; and (c) a plurality of shim plates are provided in said recess in said bottom surface of said wedge, whereby the radial distance between said floor surface on said vane carrier and said bottom surface of said wedge can be varied by varying the number of said plurality of shim plates in said recess.

3. A turbine as recited in claim 1 and further comprising:

(a) a driving washer mounted on said screw between said vane carrier and said wedge and (b) means for fixing said driving washer against movement relative to said screw.

4. A turbine as recited in claim 3 wherein said means comprise a set screw threadedly engaged in said driving washer and positioned to bear against said screw.

5. A turbine as recited in claim 1 wherein a plurality of said wedges are disposed in said annular groove.

6. A turbine as recited in claim 1 wherein the radially outer end of said wedge contact surface is closer to said end surface than is the radially inner end of said wedge contact surface.

* * * * *